US011433929B2

(12) United States Patent
Euston et al.

(10) Patent No.: US 11,433,929 B2
(45) Date of Patent: Sep. 6, 2022

(54) RAILROAD TRACK GUIDANCE SYSTEMS AND METHODS

(71) Applicant: GEORGETOWN RAIL EQUIPMENT COMPANY, Georgetown, TX (US)

(72) Inventors: Todd L. Euston, Austin, TX (US); Gregory T. Grissom, Georgetown, TX (US); Jeb E. Belcher, Georgetown, TX (US); Antonio R. Mauricio, Round Rock, TX (US); John J. Kainer, Georgetown, TX (US); Ryan S. Richard, Temple, TX (US); Carlos A. Repelli, Georgetown, TX (US); Charles W. Aaron, Bertram, TX (US)

(73) Assignee: Loram Technologies, Inc., Georgetown, TX (US)

( * ) Notice: Subject to any disclaimer, the term of this patent is extended or adjusted under 35 U.S.C. 154(b) by 840 days.

(21) Appl. No.: 15/943,981

(22) Filed: Apr. 3, 2018

(65) Prior Publication Data

US 2018/0281829 A1 Oct. 4, 2018

Related U.S. Application Data

(60) Provisional application No. 62/481,425, filed on Apr. 4, 2017.

(51) Int. Cl.
*B61K 9/08* (2006.01)
*E01B 35/10* (2006.01)
(Continued)

(52) U.S. Cl.
CPC ..... *B61K 9/08* (2013.01); *B61L 23/042* (2013.01); *B61L 23/048* (2013.01);
(Continued)

(58) Field of Classification Search
CPC .... B61L 23/042; B61L 23/044; B61L 23/045; B61L 23/047; E01B 31/18; E01B 31/20; E01B 35/06
See application file for complete search history.

(56) References Cited

U.S. PATENT DOCUMENTS 5,791,063 A * 8/1998 Kesler ..... E01B 35/00 33/1 Q
9,031,188 B2 5/2015 Belcher et al.
(Continued)

FOREIGN PATENT DOCUMENTS

CN 101954916 A * 1/2011
GB 2567865 A * 5/2019 ..... B61L 23/045

OTHER PUBLICATIONS

European Patent Office; International Search Report and Written Opinion for Application No. PCT/US2018/026011 dated Aug. 6, 2018.

*Primary Examiner* — Donald J Wallace
(74) *Attorney, Agent, or Firm* — Parsons Behle & Latimer

(57) ABSTRACT

A method for locating railroad components along a railroad track including obtaining a guidance plan and obtaining inspection data. The guidance plan includes an identity of each of a plurality of assets, the identity including previous features of the assets. The assets may be railroad components. The inspection data includes current features of a plurality of railroad components along the railroad track. The method includes using one or more processors, comparing and correlating the current features of the plurality of railroad components with the previous features of the assets to determine which of the plurality of railroad components corresponds with the plurality of assets.

36 Claims, 4 Drawing Sheets

(51) Int. Cl.

| | |
|---|---|
| ***E01B 35/02*** | (2006.01) |
| ***B61L 25/02*** | (2006.01) |
| ***B61L 23/04*** | (2006.01) |
| ***E01B 35/00*** | (2006.01) |
| *E01B 29/06* | (2006.01) |

(52) U.S. Cl.
CPC ..... *B61L 25/026* (2013.01); *E01B 35/00* (2013.01); *E01B 35/02* (2013.01); *E01B 35/10* (2013.01); *E01B 29/06* (2013.01)

(56) References Cited

U.S. PATENT DOCUMENTS

| | | | | |
|---|---|---|---|---|
| 9,441,956 | B2 | 9/2016 | Kainer et al. | |
| 2012/0192756 | A1* | 8/2012 | Miller | B61L 23/048 104/2 |
| 2013/0202090 | A1* | 8/2013 | Belcher | B61K 9/10 378/87 |
| 2015/0109617 | A1* | 4/2015 | Gilbert | G01J 3/42 356/300 |
| 2015/0131108 | A1* | 5/2015 | Kainer | B61L 23/044 356/612 |
| 2015/0375765 | A1* | 12/2015 | Mustard | E01B 31/18 701/19 |
| 2017/0106885 | A1* | 4/2017 | Singh | G01B 11/22 |
| 2019/0300032 | A1* | 10/2019 | Asuka | B61L 27/0088 |

* cited by examiner

RAILROAD TRACK GUIDANCE SYSTEMS AND METHODS

CROSS REFERENCE TO RELATED APPLICATION

The present application claims the benefit of priority under 35 U.S.C. § 119 to U.S. Provisional Application No. 62/481,425, filed Apr. 4, 2017, entitled "Marking system and Method," the disclosure of which is incorporated herein by reference in its entirety.

FIELD OF THE DISCLOSURE

The embodiments described herein relate generally to a system to mark or locate assets along a predetermined path. In particular, the disclosure relates a guidance system to compare and correlate data sets collected over the same railroad track at different times in order to verify the location of the system on the subsequent pass. Also, the disclosure relates to an automated system to mark railroad components, such as crossties, to be replaced or repaired. Some embodiments within the disclosure relate to physical marking of railroad components.

BACKGROUND

Railroad components, such as crossties ("ties"), are exposed to mechanical, chemical, and environmental forces and over time, the condition of the railroad components may degrade, such that it no longer functions effectively. In the case of ties, the degraded ties may no longer support the railroad track loads and/or provide a fixed track gage. The condition of the railroad components may be inadequate for a desired purpose or may need to otherwise be replaced. For instance, a sufficient number of ties within a certain length of track may have degraded and therefore need to be replaced, rail spikes may be missing, and/or a rail may have become damaged.

A railroad company may replace damaged ties with specialized machines designed to traverse the track to remove selected ties and replace them with new ties to restore the track to a suitable service condition. Likewise, specialized machines and/or railroad workers may replace other railroad components, such as joint bars, tie plates, fasteners, spikes, and rails. However, in order to designate which ties are to be removed from a track and replaced, a railroad worker will typically walk along the ties and create a paint mark on or near the tie to be removed as an indicator for the crew replacing ties. In some cases, the railroad worker will exercise his discretion to select the correct ties to be replaced. A walking tie marking worker may achieve a walking rate of 1-2 miles per hour, depending on several factors such as track condition and if he must make on the spot decisions about which ties to replace. If he is allowed to make subjective decisions about which ties may be replaced, he may erroneously leave behind ties in very poor condition or replace ties in relatively good condition. In addition, individualized analysis by the worker is time consuming and may be undesirable. Non-optimal tie replacement can have significant economic effects on a railroad's capital and maintenance budgets by replacing ties before they have reached the end of their useful lives, and by leaving behind conditions that will require earlier maintenance interventions than desired. In addition, railroad workers walking along railroad tracks may increase the opportunity for accidents and/or may decrease useable track time.

SUMMARY

The present disclosure is directed to systems and methods that overcome some of the problems and disadvantages discussed above. Other disadvantages may exist. Furthermore, although the embodiments described below have been described in the context of the railroad industry, it is appreciated that the system and methods disclosed herein may be used to mark or service other assets positioned along a predetermined path. For example, the systems and methods described herein may be used to mark damaged or missing lane markers along a highway, potholes to be repaired along a road, or trip hazards and separated concrete on a sidewalk or trail.

An embodiment of a system for marking assets along a predetermined path includes a marking tool and a controller. The marking tool is configured to travel along the predetermined path and place indicators, visual or others such as RFID, chemical, or optical markers, upon or near assets. The controller includes programming to implement a guidance plan. The guidance plan may include a position of the asset along the predetermined path to be marked by the marking tool. The system may include a trigger to initiate and terminate the operation of the marking tool. The trigger may be integral to the marking tool. The controller is in communication with the trigger to implement the guidance plan.

The system may include a rail-traversing vehicle. The marking tool may be mounted on the rail-traversing vehicle or on a trailer configured to be towed by the rail-traversing vehicle. The system may include a coordinate locating system configured to provide a real-time location of the marking tool. The coordinate locating system may include a GPS system. The coordinate locating system may include an encoder.

The controller may include one or more algorithms configured to compare and correlate the real-time location of the marking tool with the position of one of the assets. The system may include an inspection system configured to obtain current features of assets along the predetermined path. The controller may include programming to compare and correlate the current features of the assets with prior features of the assets to determine a location of the marking tool relative to the one of the assets. The prior features of the assets may be included within the guidance plan. The controller may include programming to compare and correlate the current features of a reference component with prior features of the reference component to determine a location of the marking tool relative to the one of the assets to be marked. The position of the one of the assets may be a known relative position from the reference component.

An embodiment of a method for marking assets along a predetermined path includes obtaining a guidance plan identifying assets along a predetermined path, traversing the predetermined path with a marking tool, using a processor to correlate a location of the marking tool with a position of one of the assets identified in the guidance plan, signaling the marking tool with the processor when the marking tool is aligned with one of the assets identified in the guidance plan, and marking the assets identified in the guidance plan.

The method may include generating the guidance plan identifying the assets along the predetermined path. Generating the guidance plan identifying the assets along the predetermined path may include performing a survey along the predetermined path, identifying the assets and the positions of the assets along the predetermined path, analyzing the condition of the assets, and generating the guidance plan identifying specific assets along the predetermined path. The method may include inspecting the predetermined path and obtaining current features of the assets along the predetermined path. Using a processor to correlate a location of the marking tool with a position of one of the assets may include obtaining prior features of the assets along the predetermined path, and using the processor to compare and correlate the current features with the prior features to determine the location of the marking tool relative to the position of one of the assets identified in the guidance plan.

An embodiment of a system for locating components along a predetermined path includes an inspection system, survey data, and a controller. The inspection system is configured to travel along a predetermined path and obtain inspection data. The inspection data corresponds to features of the predetermined path. The survey data corresponds to features of the predetermined path at a time earlier than the inspection data. The controller has one or more processors, configured to analyze the inspection data by applying one or more algorithms to compare and correlate the features in the inspection data with the features in the survey data to determine a location of the system.

The inspection data may include a first image of a portion of the predetermined path and the survey data may include a second image of a portion of the predetermined path. The system may include a guidance plan having an identity and position for an asset along the predetermined path. The system may include a tool configured to travel along the predetermined path. The controller is in communication with the tool, and the controller include programming to operate the tool in accordance with the guidance plan. The guidance plan may include an action corresponding to the asset in the guidance plan. The tool may be a marking tool configured to place physical indicators upon or near the asset, and the controller may include programming to initiate and terminate operation of the marking tool.

The physical indicators may include one or more of a paint mark, a RFID tag, a reflective fluid, a chemical indicator, or a combination or subset thereof. The predetermined path may a railroad track and the system may include a rail-traversing vehicle. The tool may be mounted on the rail-traversing vehicle. The tool may be mounted on a trailer configured to be towed behind the rail-traversing vehicle. The system may include a coordinate locating system configured to provide a real-time location of the tool. The coordinate locating system may include an encoder. The inspection data and the survey data may each include features of one or more reference components, and the controller includes one or more algorithms configured to compare and correlate the features of the one or more reference components in the inspection data with the features of the one or more reference components in the survey data to determine a location of the tool relative to the asset, the position of the asset being a known relative position from the one or more reference components.

An embodiment of a method for locating components along a predetermined path includes obtaining survey data of a predetermined path and traversing the predetermined path with an inspection system. The survey data includes previous features of the predetermined path. The method includes using the inspection system to obtain inspection data of the predetermined path, the inspection data including current features of the predetermined path, and using one or more processors, comparing and correlating the current features and the previous features to determine a position of the inspection system.

The method may include obtaining a guidance plan, the guidance plan including an identity and a position of each of a plurality of assets along the predetermined path. The method may include aligning a tool with one of the plurality of assets after determining the position of the inspection system. The tool may be a marking tool, and the method may include signaling the marking tool with the one or more processors when the marking tool is aligned with one of the plurality of assets, and marking the plurality of assets. Obtaining the guidance plan may comprise generating the guidance plan by performing a survey of the predetermined path, identifying a plurality of components along the predetermined path, analyzing a condition of the plurality of components, identifying a subset of the plurality of components as the plurality of assets, and generating the guidance plan with the plurality of assets.

The predetermined path may be a railroad track and the plurality of assets may be a plurality of railroad components. The plurality of railroad components may include railroad ties. The current features may include a relative spacing of a group of the railroad ties and the previous features may include the relative spacing of the group of railroad ties. The inspection data may include a first image of a portion of the railroad track and the survey data may include a second image of a portion of the railroad track.

An embodiment of a method for locating railroad components along a railroad track includes obtaining a guidance plan and obtaining inspection data. The guidance plan includes an identity of each of a plurality of assets, the identity including previous features of the assets. The assets may be railroad components. The inspection data includes current features of a plurality of railroad components along the railroad track. The method includes using one or more processors, comparing and correlating the current features of the plurality of railroad components with the previous features of the assets to determine which of the plurality of railroad components corresponds with the plurality of assets.

The comparing and correlating may be performed while traversing the railroad track. The identity of each of the plurality of assets may include a position of the asset. The position of the asset may be comprised of an identity of one or more reference components and a relative position of the asset with respect to the one or more reference components. The plurality of assets may include railroad ties. The previous features of the railroad ties may include a relative spacing of a group of the railroad ties. The previous features of the railroad ties may include a leading edge and a trailing edge of the railroad ties.

The method may include traversing the railroad track with a tool and aligning the tool with one of the plurality of assets. The method may include repairing or replacing the one of the plurality of assets using the tool. The method may include physically marking the one of the plurality of assets using the tool. At least some of the plurality of railroad components may include an RFID tag with a component identifier and the previous features of the plurality of assets may include the component identifier. The method may include creating an alert when one of the plurality of railroad components correlated to one of the plurality of assets contains current features that are different from the previous features.

An embodiment of a method for locating railroad components along a railroad track includes obtaining a guidance plan and obtaining inspection data. The inspection data includes current features of a plurality of railroad components along a railroad track. The guidance plan includes an identity of each of a plurality of assets along the railroad track. The assets may be railroad components. The method includes traversing the railroad track with a tool and aligning the tool with one of the plurality of assets.

The method may include traversing the railroad track with an inspection system to obtain the inspection data and the tool traversing the railroad track behind the inspection system. The tool may be positioned within a consist with the inspection system. The identity of each of the plurality of assets may include one or more of a known position of the tool with respect to the inspection system, a velocity of the inspection system along the railroad track, a velocity of the tool along the railroad track, or real-time location coordinates from a coordinate locating system. The real-time location coordinates may be encoder measurements. The method may include generating the guidance plan from the inspection data.

The identity may include previous features of the assets. The method may include using one or more processors, comparing and correlating the current features of the plurality of railroad components with the previous features of the assets to determine which of the plurality of railroad components corresponds with the plurality of assets. The comparing and correlating may be performed while traversing the railroad track. The identity of each of the plurality of assets may include a position of the asset. The position of the asset may be comprised of an identity of one or more reference components and a relative position of the asset with respect to the one or more reference components. The plurality of assets may include railroad ties. The previous features of the railroad ties may include a relative spacing of a group of the railroad ties. The previous features of the railroad ties may include a leading edge and a trailing edge of the railroad ties.

At least some of the plurality of railroad components may include an RFID tag with a component identifier and the previous features of the plurality of assets may include the component identifier. The method may include creating an alert when one of the plurality of railroad components correlated to one of the plurality of assets contains current features that are different from the previous features. The method may include repairing or replacing the one of the plurality of assets using the tool. The method may include physically marking the one of the plurality of assets using the tool.

An embodiment of a method for locating railroad components along a railroad track includes traversing a railroad track with an inspection system, using the inspection system to obtain inspection data of the railroad track, and generating a guidance plan. The inspection data includes current features of a plurality of railroad components along the railroad track. The guidance plan is generated by using one or more processors, applying a set of rules or statistical analysis to the inspection data to identify a subset of the plurality of railroad components to be serviced or marked, and selecting the subset of the plurality of railroad components as a plurality of assets within the guidance plan. The guidance plan includes a position of each of the plurality of assets along the railroad track. The traversing the railroad track with the inspection system and the generating the guidance plan are performed in a single pass along the railroad track. The method may include traversing the railroad track with a tool and aligning the tool with one of the plurality of assets using the guidance plan. The tool may form part of the same consist as the inspection system.

Figure 1:
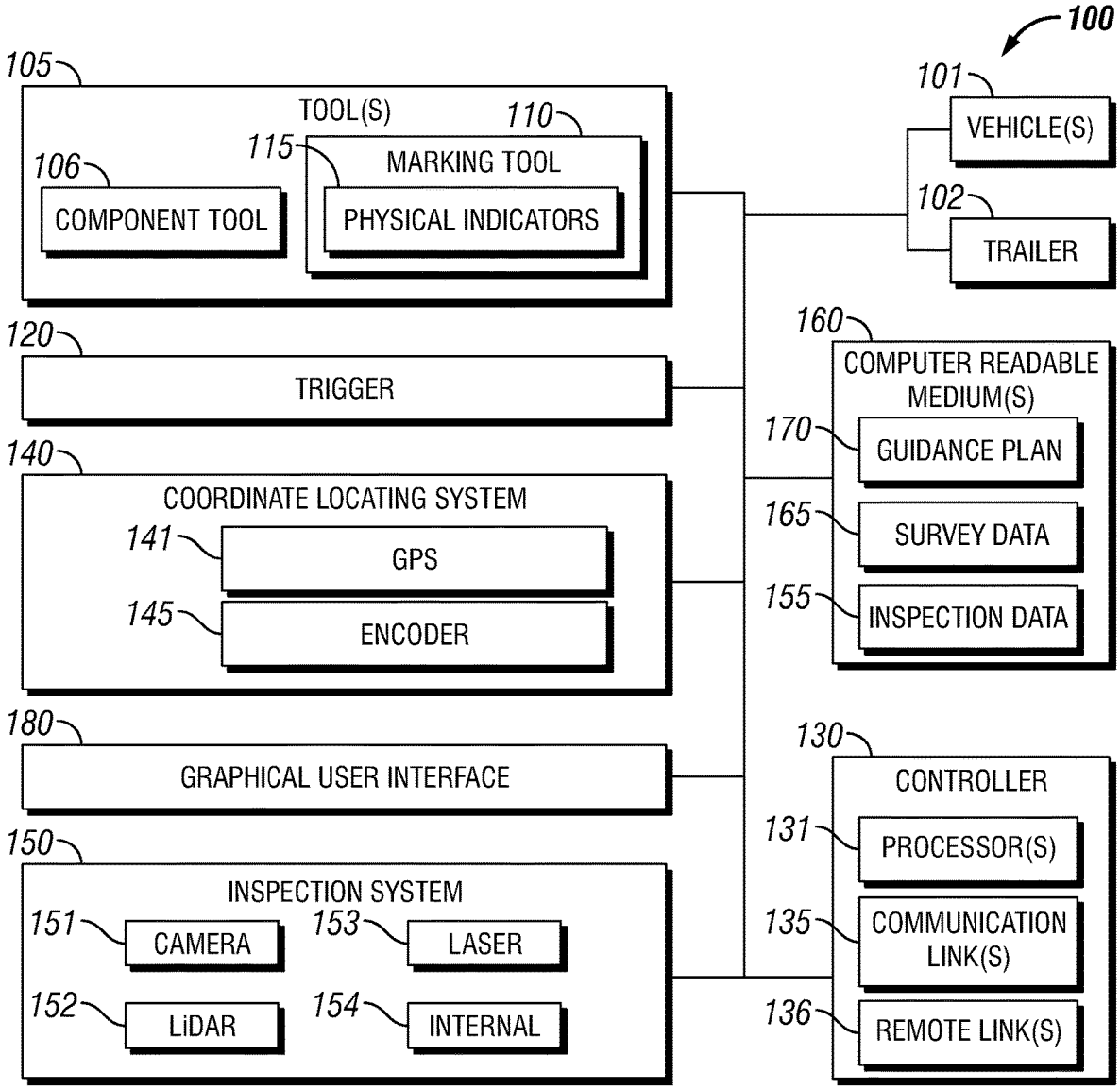
FIG. 1 shows an embodiment of a system for locating and servicing assets along a predetermined path.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

An embodiment of a system 100 for locating and servicing assets, such as railroad components, along a predetermined path, such as a railroad track, is shown in FIG. 1. The system 100 includes one or more tools 105, an inspection system 150, and one or more computer readable mediums 160 capable of storing data. The tools 105 may be located a known distance from the inspection system 150. By way of example, the tools 105 may be a component tool 106 for servicing a railroad component and/or a marking tool 110. Examples of a component tool 106 include machines in a tie gang, to remove or install spikes, to remove or install tie plates, to remove or install clips or insulators, to remove or install a tie, to install, apply epoxy to, or adz a tie, to inject filler into a hollow tie, to tight bolts of a fastener or joint bar, or to repair a rail. In addition, the component tool 106 may be an alarm system used by railroad workers to alert the railroad worker when an action should be taken, or a remote device, such as a drone, to be controlled in relation to the location of a particular component on the railroad track.

The inspection system 150 is configured to scan and collect features of the predetermined path, such as a component's characteristics, including thermal characteristics, surface profile, position coordinates, and internal characteristics, and/or an image of the predetermined path and components along the predetermined path. The inspection system 150 may include one or more of a camera 151, LiDAR 152, laser 153, or internal imaging system 154, such as x-ray or neutron inspection systems. The inspection system 150 may include a 2D or 3D machine vision system. The inspection system 150 may include a system described in U.S. Pat. No. 9,441,956, entitled "System and Method for Inspecting Railroad Ties" filed on Jan. 19, 2015, the disclosure of which is incorporated herein by reference in its entirety. The internal imaging system 154 may include a system described in U.S. Pat. No. 9,031,188, entitled "Internal Imaging System" filed on Feb. 7, 2013, the disclosure of which is incorporated herein by reference in its entirety.

The computer readable mediums 160 are capable of storing current inspection data 155, a guidance plan 170, and survey data 165. The inspection system 150 traverses and examines the predetermined path to collect the inspection data 155, which is compared with previously collected survey data 165 of the same path. The current inspection data 155 and survey data 165 each includes features of the predetermined path, such as a component's characteristics, including thermal characteristics, surface profile, position coordinates, and internal characteristics, and/or an image of the predetermined path and components along the predetermined path. As used herein, historical data of the predetermined path is referred to as survey data while current data is referred to as inspection data. However, the survey data 165 and the inspection data 155 include the same or overlapping categories of information, and in some embodiments may be gathered using the same system and analysis. The inspection data 155 may be gathered during a current pass while the survey data 165 may be gathered during one or more prior passes along the predetermined path. The survey data 165 may be compiled using information gathered from multiple surveys. Multiple surveys may be used to track characteristics over time; such as if a component changes positions, is wearing at an accelerated rate, or is subject to fluctuations in heat.

Both the survey data 165 and the inspection data 155 may be gathered using the same inspection system 150. In some embodiments, the survey data 165 and the inspection data 155 may be gathered using different systems. For example, survey data 165 may be collected by a drone traversing the predetermined path and equipped with a camera 151, LiDAR 152, and/or a laser 153. The inspection data 155 may be gathered via the inspection system 150, which may be mounted upon a vehicle 101 traveling on rails of the railroad track. The current inspection data 155 is provided to a processor 131 of a controller 130 in order to correlate features of the asset identities 171 in the guidance plan 170 with features of the components at the current location. For example, the processor 131 may compare a first image of a portion of the railroad track with a second image of the railroad track and execute one or more algorithms to correlate features within the images. An operator may also select a portion of the images to be correlated.

The guidance plan 170 includes information relating to assets along the predetermined path. The survey data 165 is analyzed to determine which components along the predetermined path should be identified in the guidance plan 170. As used herein, the term asset refers to a specific component along the predetermined path that has been identified to warrant additional inspection, maintenance, or replacement. For example, an asset may be a railroad tie that needs to be replaced, a missing spike, an anchor, a field weld, a rail, a joint bar, a tie plate, a missing component, or a region of track to be measured and verified. Likewise, components with a grade below a predetermined level may be designated as an asset. It is appreciated that the methods and systems described herein may be applicable to a wide variety of railroad maintenance. When inspection data 155 is collected representing the current condition of components along the predetermined path, similarities between the current data and the historical data are used to identify which of the components are the assets and to verify the location so that the right component may be serviced or marked.

Figure 2:
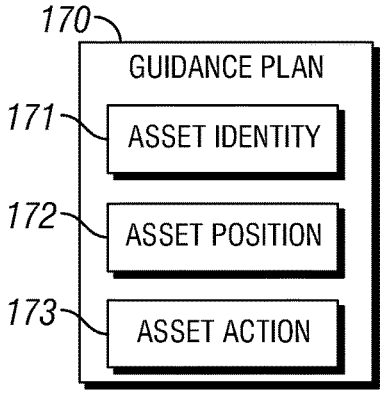
FIG. 2 shows an embodiment of a guidance plan.

An exemplary embodiment of a guidance plan 170 is shown in FIG. 2. The guidance plan 170 includes data representing the identity 171 of assets to be marked, the positions 172 of the assets, and an action 173 that corresponds to each asset. The asset's identity 171 may include features of the asset that corresponds to survey data 165 that can be used to correlate and verify the identity 171 of assets as one of the components at the current location of system 100. The position 172 of each asset may include a single position that corresponds to a point on or near a specific asset or may include multiple positions, such as the leading and trailing edges of a tie or the ends of a joint bar. In some embodiments, the positions 172 may span a plurality of assets to identify a larger section for replacement, repair, or inspection. The guidance plan 170 may include only asset identities 171 to be marked at each end of the larger section, such as a consecutive group of ties that require replacement. The guidance plan 170 may be a single file or may comprise multiple files. For example, a first file may include the identity 171 of assets and their positions 172 for ties that need replaced, and a second file may include the identity 171 of assets and their positions 172 for tie plates that need replaced.

The system 100 may include a coordinate locating system 140, such as a GPS system 141 and/or encoder 145, configured to provide real-time location coordinates of the system 100. The encoder 145 measures linear distance traveled along the track. The encoder 145 may be a single encoder or multiple encoders. The real-time location coordinates from the coordinate locating system 140 are provided to the processor(s) 131 of the controller 130 in order to correlate the position 172 of the assets in the guidance plan 170 with the railroad components at the current location. The real-time location coordinates may be directly provided to the processor(s) 131 or first stored in the computer readable medium 160, such as in the current inspection data 155.

Data from the GPS system 141, encoder 145, or combinations thereof may be sufficient to accurately correlate a component at the current location with the identity 171 and position 172 of an asset in the guidance plan 170. In some instances, GPS data alone may be insufficient to provide the level of detail necessary. Data from the GPS system 141 may be used to identify a region where the system 100 is located. GPS data may be further limited inside tunnels or in narrow valleys. Data from an encoder 145 may be used to further refine the GPS estimates. However, data from the GPS system 141 and encoder 145 may be subject to errors such as scaling and slippage. For example, a level of certain greater than 18" could result in misidentifying a tie for replacement, when it is actually a neighboring tie that needs replaced. Similarly, even greater precision may be required for operations such as identifying or replacing damaged spikes. Correlation of the features in the asset identity 171 to features of the component at the current location may be used to identify the component as the asset.

The system 100 includes a controller 130 to correlate the location of the system 100 with asset positions 172 so that an action 173 in the guidance plan 170 associated with the identity 171 of that asset may be executed. The controller 130 includes one or more processor(s) 131. In some embodiments, the controller 130 includes a remote link 136 to access remotely stored data. The computer readable mediums 160 may be contained within the controller 130. The guidance plan 170 may be stored directly on a computer readable medium 160 of the controller 130. The controller 130 accesses, locally or remotely, a guidance plan 170 corresponding to the predetermined path being traveled. The controller 130, or another controller, may also be utilized to operate the inspection system 150.

The controller 130 includes programming to access the guidance plan 170 to determine the identity 171 and the position 172 of assets to be marked. The controller 130 also includes one or more algorithms to be executed by the processor(s) 131 to correlate the current location of a portion of the system 100 with the position 172 of an asset within the guidance plan 170. As the system 100 traverses railroad tracks, the processor(s) 131 correlate the location of the railroad components near the system 100 with the position 172 of an asset in the guidance plan 170 using real-time location data and/or by correlating features in the asset identity 71 to features of the component at the current location. In some embodiments, the controller 130, or another controller, provides and/or receives information with a graphical user interface 180. The graphical user interface 180 may be a computer or tablet computer positioned within a cab of a hi-rail vehicle, for example. Inspection data 155 from the current pass along the predetermined path may be a displayed side-by-side or overlaid with the survey data 165 such that an operator viewing the graphical user interface 180 can view the correlation between the data. In some instances, the operator may make adjustments to the correlated data.

Once an asset has been located, it is "marked" logically for further actions. A notification may be presented through the graphical user interface 180, such as a visual or audible alert, to indicate that a component has been recognized as an asset within the guidance plan 170. The controller 130 may determine the action 173 that corresponds to the identity 171 and position 172 of the located asset. The action 173 may include aligning one of the tools 105 with the located asset. The action 173 may include physically marking the asset with the marking tool 110 so that it can be more readily identified by a team performing maintenance, such as a tie gang. The physical and logical marking may form a single action. In some embodiments, one or more actions 173 may be displayed upon the graphical user interface 180 for selection by an operator. The action 173 may be to perform maintenance on the asset with the component tool 106, such as replacing a tie, placing a spike in a tie plate, or tightening a joint bar. In some cases, the action 173 may be to alert an operator that the features contained within the inspection data 155 and the features contained within the survey data 165 are different, indicating that a change to the component has occurred. The component tool 106 may be used to service the asset as part of overall maintenance operations or the marking tool 110 may be used to place a physical indicator 115 on or near the asset. Depending on the type of railroad maintenance to be performed, performing the service as part of the same consist as the inspection system 150 may reduce the need for physical markers, reduce opportunities for misidentification, and/or expedite maintenance operations. In instances where it is desired or needed to perform the maintenance operations at a later time, the physical indicator 115 may be used to more readily identify the asset. Likewise, the physical indicators 115 may be selected to correspond to an indicator detector on a component tool 106.

Figure 3:
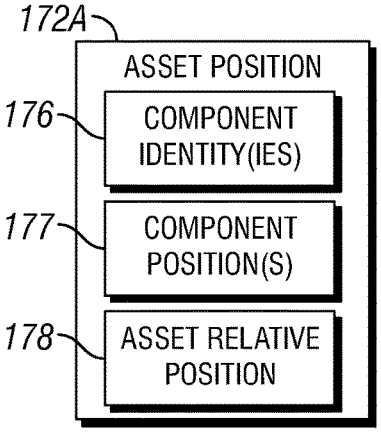
FIG. 3 shows an embodiment of an asset position of an embodiment of a guidance plan.

In some embodiments, the asset position 172 may be determined by the correlation of features of reference components at a current location with prior features of the reference components from the survey data 165 and used as a frame of reference to locate assets to be marked. For example, the reference component may be another railroad component or identifiable component along the predetermined path. FIG. 3 shows an embodiment of data representing the asset position 172A using reference components that may be substituted or supplemented as the asset position 172 in the guidance plan 170. The asset position 172A includes data representing identities 176 of one or more reference components, the positions 177 of the reference components, and the relative position 178 of the asset with respect to the reference components. The identity 176 of the reference components includes features of the reference component that correspond to the survey data 165 and may be correlated to verify the identity 176 of the reference component. The position 177 of the reference component may include a single position that corresponds to a point on the reference component or may include multiple positions, such as the leading and trailing edges of a tie or the ends of a joint bar. The reference components may be more readily identifiable components, such as a split tie or missing tie or spike, and used to more rapidly locate the asset nearby. The use of reference components may be especially beneficial when using the system 10 to detect changes in track condition. For example, the condition of a tie may have deteriorated to the point that there is a poor correlation of the features of the tie between the previously collected survey data 165 and the current inspection data 155, but the group of adjacent ties has a strong correlation. Additional application may also include determining changes to the track by wear or theft of components, or by natural conditions such as a flood. It is appreciated that the guidance plan 170 may designate all components along the railroad track, or a portion thereof, as assets to check for changes in the condition of the component, even if other actions of marking or servicing the component have not been designated.

The controller 130 includes programming to access the asset position 172A in the guidance plan 170 to determine the identities 176 and positions 177 of the reference components. The controller 130 also includes one or more algorithms to be executed by the processor(s) 131 to correlate the location of a component on the railroad track with the position 177 of the reference component in the guidance plan 170A to determine the current location of the system 100 or one of the tools 105, such as the marking tool 110. The controller 130 may include programming to be executed by the processor(s) 131 to utilize the relative position 178 in the asset position 172A to align one of the tools 105 with the asset. According to the action 173 associated with the asset, the asset may be marked using the marking tool 110 or serviced via the component tool 106. The asset may also be marked, logically or physically, for further observation.

For example, the controller 130 may correlate the current features of a joint bar with previously surveyed features of the joint bar and thereby determine the location of the tool 105 along the railroad track. Once the location of the tool 105 has been determined, the action 173 for that asset may be executed on the asset. For instance, the marking tool 110 may be used to mark the joint bar. Alternatively or in addition, using the known relative position 178 of another asset, such as a tie, with respect to the joint bar, the joint bar may be used as a reference point to guide the tool 105 into alignment with the tie. Also for example, the component positions 177 may include the leading and trailing edges of a tie and the asset relative position 178 may identify the position of a missing spike relative to the leading and trailing edges of the tie. Therefore, the asset being marked is not necessarily the reference component whose features are correlated to determine the location of the tool 105.

The system 100 may include a trigger 120 to initiate and terminate operation of the tools 105. The trigger 120 is connected to the controller 130 via a communication link 135. The communication link 135 represents generally any combination of cable, wireless, or remote connection via a telecommunication link, an infrared link, a radio frequency link, or any other connectors or systems that provides electronic communication between the trigger 120 and the controller 130. In some embodiments, the trigger 120 is integral to the tools 105 themselves. The trigger 120 may be automatically operated by the controller 130. In embodiments comprising multiple tools 105, such as one or more component tools 106 and/or a marking tool 110, the trigger 120 may initiate and terminate operation of the tools 105 independently of each other. The trigger 120 may cause a tie or joint bar to be marked with a physical indicator 115 in one section and cause replacement operations to commence on a tie at another section of the consist.

An embodiment of a marking tool 110 and its operation includes the controller 130 accessing the guidance plan to determine the identity 171 and position 172 of assets to be physically marked. The controller 130 includes one or more algorithms to be executed by the processor(s) 131 to correlate the current location of the marking tool 110 with the position 172 of the pre-identified assets 171 within the guidance plan 170. As the system 100 travels along the predetermined path, the controller 130 correlates the current location of the marking tool 110 with the position 172 of the assets to be marked and signals the trigger 120 to initiate a marking phase when the marking tool 110 is aligned with one of the assets. Once a physical indicator 115 has been placed on or near the asset, the controller 130 releases the trigger 120 to terminate the marking phase.

A physical indicator 115 placed near an asset may not be on an asset, but is close enough to indicate which asset is being marked. For example, a physical indicator 115 near a tie may be on the ballast or rail adjacent to the tie, and a physical indicator 115 for a tie plate may be on the tie adjacent to the tie plate. The marking tool 110 may include a laser configured to mark assets along the predetermined path. The physical indicators 115 may be paint marks. The marking tool 110 may include a sprayer, dauber, or gun positioned to paint a portion of a railroad component along the railroad track as the system 100 traverses the railroad track. The physical indicators 115 may be more permanent than paint. The physical indicators 115 may be chemical, electrical, or radio. For example, the physical indicators 115 may be a RFID tag applied with an adhesive or mechanical fastener. The physical indicators 115 may be a reflective fluid or chemical detectable by a railroad worker and/or sensor. The physical indicators 115 may be an etching or engraving. The physical indicator 115 may be an object with a specific shape or physical characteristic or a change of a shape or characteristic of the component being marked. For example, the physical indicators 115 may have a shape that is not common to the component being examined, such as a cube or pyramid shape, so that it may be more readily distinguished from the component. The physical indicator 115 may be a magnet. For instance, a cube shaped magnet may be magnetically coupled to a rail or tie plate on a railroad track, and an inspection system 150 may be used to detect the cube shape and detect a magnetic field emitted from the physical indicator 115. Other types of physical indicators 115 are possible. The marking tool 110 may place different physical indicators 115 to designate different conditions. Different physical indicators 115 may be used to designate a type of railroad component to be replaced, a grade (rating) of a railroad component, and/or other characteristic of the railroad component. For example, different colors of physical indicators 115 may be used. A degraded tie may be marked with a first color, a misaligned or sunken tie plate marked with a second color, and a missing spike marked with a third color. In other embodiments, different physical indicators 115 may include variations in number, pattern, intensity, shape, or placement of marks. The railroad components may be directly marked. In other embodiments, the railroad component may be indirectly marked, such as by marking a tie with the second color to indicate that a tie plate associated with that tie is misaligned or sunken. In the case of railroad maintenance, physical indicators 115 may still be used when the operations are being performed by equipment within the same consist. For instance, physical indicators 115 may assist in aligning component tools 106 and/or reduce the computational requirements for preserving an asset's location as the system 100 continues to travel down the railroad tracks.

In some embodiments, a separate consist may use the physical indicators 115 to determine which operations to perform and/or to align a component tool 106 with an asset to be serviced. It is appreciated that the use of the physical indicators 115 may be used in connection with, or in some cases separate from, the correlated component features discussed herein. Physical indicators 115, such as an RFID tag, may be placed on the railroad component. The RFID tag includes a component identifier and may include a coordinate location of the railroad component. The RFID tag may include other information regarding the railroad components, such as the last date the RFID tag was accessed. The RFID tag may be used to correlate the location of a tool 105. For instance, the inspection system 150 may include a reader to access the component identifier of the RFID tag, which can then be used with information such as GPS data, encoder data, machine vision data, or combinations thereof, to correlate the location of the system 100 along the railroad track. RFID tags may be placed periodically along the railroad track or on specific components, such as railroad ties. In addition, the correlation of features and identification of a component may be conducted without the use of an RFID tag, but the RFID tag corresponding to the identified component may then be read and provided to a component tool 106 so that the component tool 106 may be aligned with the component matching the component identifier of the RFID tag. In some embodiments, the identification of components may be conducted using only RFID tags.

The system 100 may be mounted upon a vehicle 101. The vehicle 101 may be a rail-traversing vehicle. The vehicle 101 may be an unmanned aerial vehicle (UAV). The rail-traversing vehicle 101 may be a hi-rail equipped pickup truck or other vehicle traveling upon rails of the railroad track. In other embodiments, the system 100 may be mounted on a trailer 102 to be towed behind a rail-traversing vehicle 101. In still other embodiments, a portion of the system 100 may be mounted upon the rail-traversing vehicle 101 and another portion may be mounted on the towable trailer 102. For example, the controller 130 may be mounted on a rail-traversing vehicle 101 and the tools 105 may be mounted on the trailer 102 behind the rail-traversing vehicle 101. Further, a marking tool 110 may be mounted on one trailer 102 and one or more component tools 106 are mounted on one or more additional trailers 102, such as rail cars. The guidance plan 170 may be accessed by the controller 130 from within the inspection vehicle 101 and signals are sent to the trigger 120 via the communication link 135 in order to operate the tools 105. In some embodiments, the rail-traversing vehicle 101 may be the same vehicle used to conduct an initial survey to gather survey data 165 to form the guidance plan 170.

In operation, assets, such as railroad components, along the predetermined path, such as a railroad track, may be identified by comparing previous features in the survey data 165 with current features of the predetermined path in the inspection data 155. The survey data 165 is analyzed to determine an asset of interest, whose identity 171 and position 172 are placed into the guidance plan 170. As the system 100 travels along the predetermined path, inspection data 155 is generated and similarities between the survey data 165 and inspection data 155 are utilized to identify which components are assets so that they be actually physically marked and/or serviced.

Figure 4:
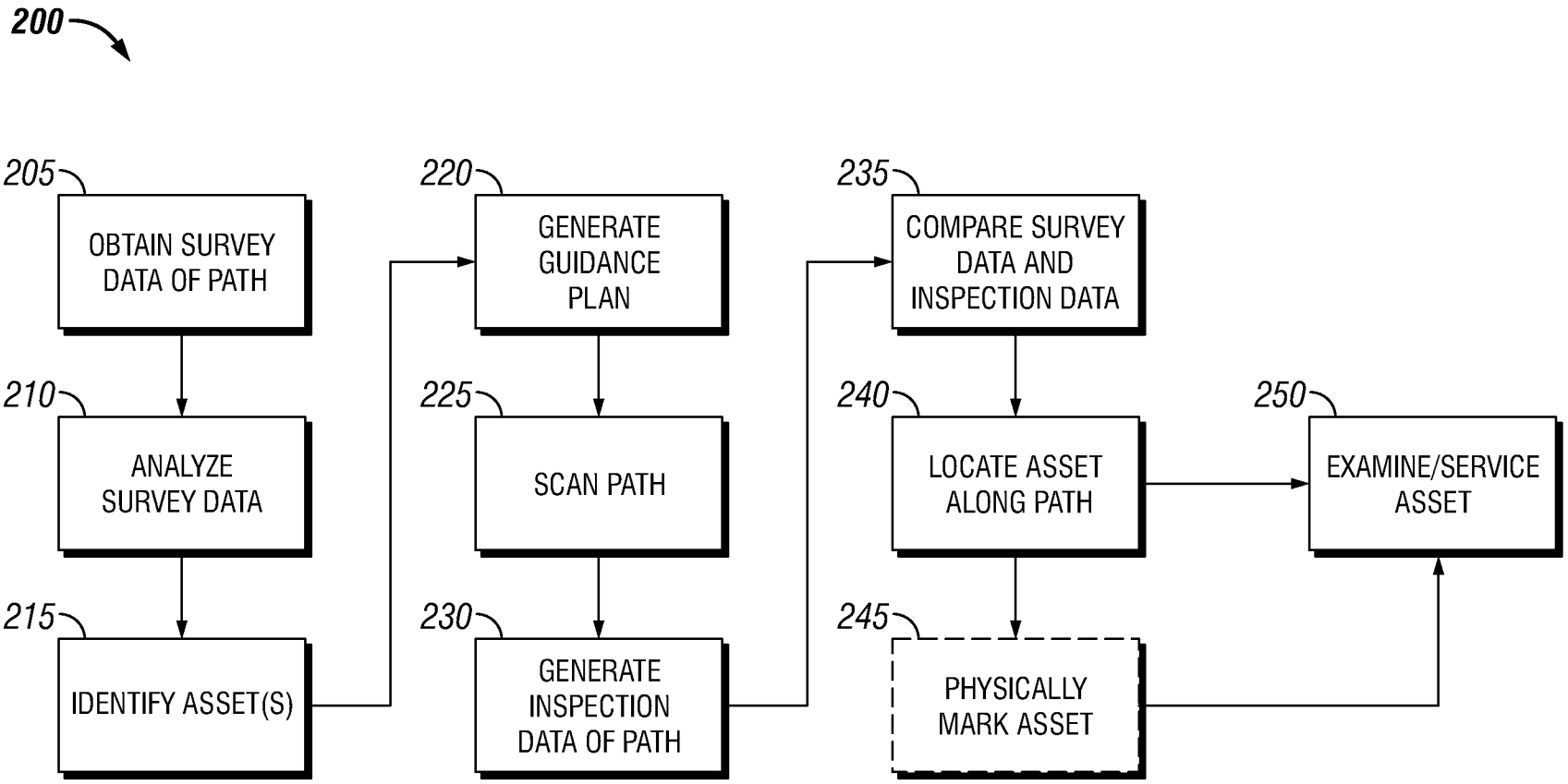
FIG. 4 shows an embodiment of a method of identifying assets along a predetermined path.

An embodiment of a method 200 for identifying assets, such as railroad components, along a predetermined path, such as a railroad track, is show in FIG. 4. The method includes Action 205, where survey data along the railroad track is obtained. The survey data may include a physical representation of the railroad track. The physical representation may be thermal data and/or image data of the railroad track. The survey data may be obtained by conducting a survey where the railroad track is scanned to capture a digitized version of features of the predetermined path, such as a component's characteristics, including thermal characteristics, surface profile, position coordinates, and internal characteristics, and/or an image of the predetermined path and components along the predetermined path. The survey data may include the location of each feature, such as GPS data, encoder data, and/or distance from another feature. As described herein, a subsequent survey to scan the railroad track is conducted in Action 225 and inspection data is generated in Action 230. The survey conducted to obtain the survey data may be conducted in the same manner. A different inspection system may be used to obtain the survey data than the inspection data. For instance, measurements to generate the survey data may be collected by a drone traversing the railroad tracks and measurements to generate the inspection data may be collected by an inspection system mounted upon a vehicle traveling upon the rails of the railroad track, such as a hi-rail vehicle, a locomotive, or a car on a consist.

In Action 210, the survey data is analyzed to identify specific assets of interest in Action 215. The assets may be identified automatically based upon certain conditions or may be manually selected. The assets may require further inspection or warrant repair or replacement. For instance, the assets may be a tie that needs replacing, a missing spike, a misaligned or missing tie plate, the presence of a field weld, a joint bar that may need replacing or tightening, or a region of track where the rail gauge needs to be adjusted or verified. The identities of the assets are used to generate a guidance plan in Action 220. The guidance plan includes characteristics of the assets and may include characteristics of other components in a region containing one of the assets.

In Action 225, the railroad track is scanned and a current physical representation of the railroad track is obtained. The railroad track may be scanned using a survey system that is similar to the system used to generate the previous survey data. Inspection data of the current conditions of the predetermined path is generated in Action 230 from the scan in Action 225. In Action 235, the inspection data is compared with the survey data. From the comparison, an asset is located in Action 240. The inspection data may be displayed side-by-side or overlaid with the survey data such that an operator viewing a graphical user interface can view the correlation between the data. The operator may make adjustments to the correlated data. Once the asset has been located, it is logically marked. A notification may be presented through the graphical user interface, such as a visual or audible alert, to indicate that a component has been recognized as an asset within the guidance plan. Depending on the types of component and the action to be performed, the asset may be marked with physical indicators in Action 245. Then, in Action 250, the asset may be examined or serviced. In some embodiments, the asset may be examined or serviced without any physical marking taking place.

In some embodiments, the physical indicators that have been placed or physical indicators that have been previously placed may be used in place of, or in addition to, GPS data, encoder data, machine vision data, or combinations thereof. The inspection system may include a reader to read the physical indicator, such as an RFID tag or chemical marker, associated with a portion of the railroad track or a railroad component. Information from the physical indicator may be used to locate an asset, or the physical indicator may serve to identify a reference component and locate the asset in relation to the reference component. In some embodiments, the identification of components may be conducted using only RFID tags.

Figure 5:
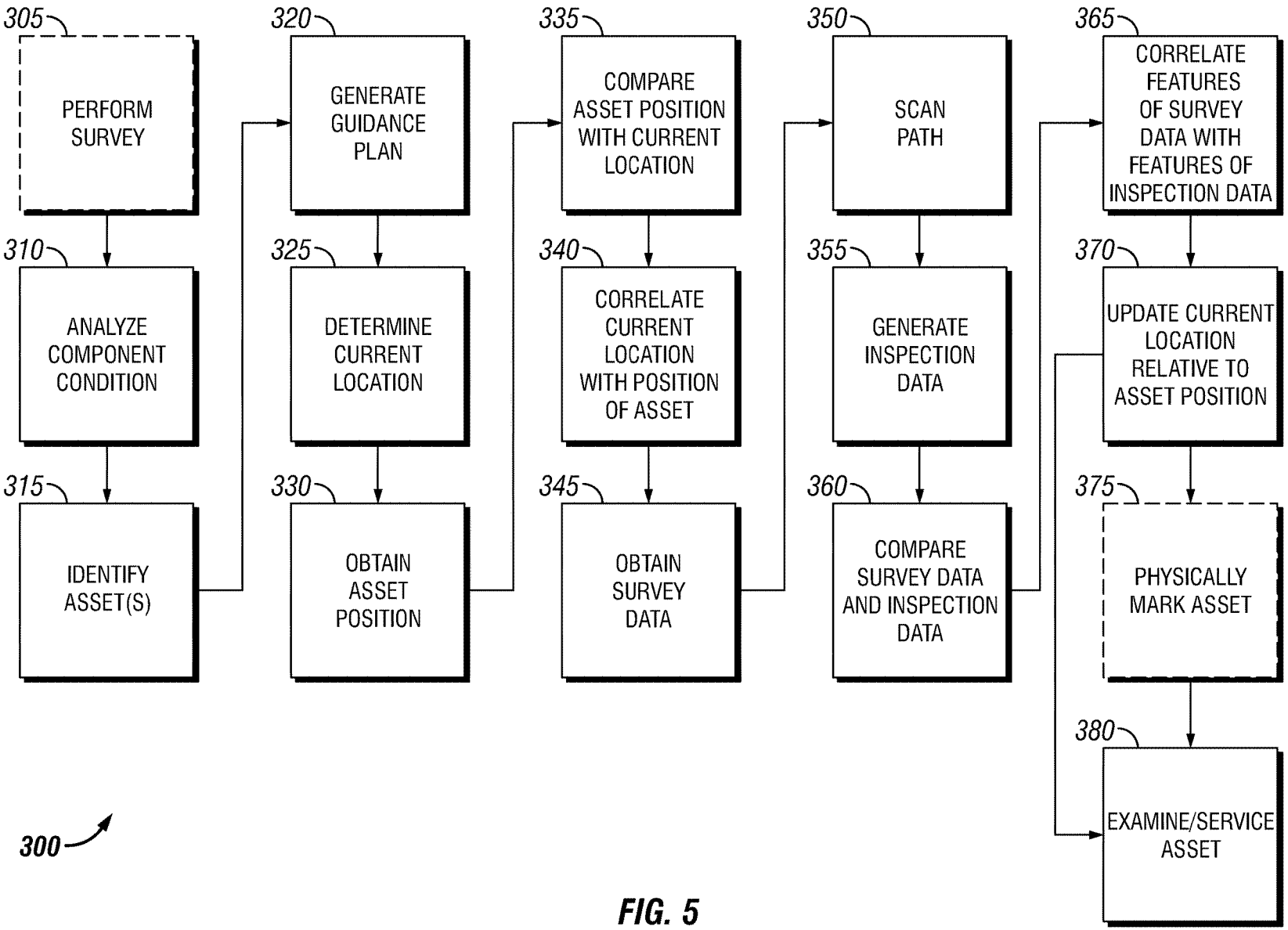
FIG. 5 shows an embodiment of a method of identifying assets along a predetermined path.

FIG. 5 is a flow diagram of a method 300 for identifying and marking an asset along a predetermined path according to one embodiment. The method 300 may include the Action 305 of performing a survey along a predetermined path. In Action 310 of method 300, the survey results are analyzed to determine the condition of components along the predetermined path. A plurality of components along the predetermined path are identified from the survey. A grade (rating) of components may be assigned based upon selected criteria. Action 315 identifies a subset of the plurality of components, which are designated as assets, that need to be repaired, replaced, inspected, or that are desired to be otherwise marked. For example, components with a grade below a predetermined level may be designated as assets. In some embodiments, results from multiple surveys may be analyzed to determine the condition of components along the predetermined path. For example, position or temperature characteristics over multiple surveys may be used.

The method 300 includes Action 320 of generating a guidance plan that identifies which of the components have been designated as assets. The guidance plan includes an asset identity and position. The asset identity includes features of the asset that correspond to survey data received from steps 305 and 310 that may be used to correlate and verify the identity of the asset. The position may include coordinates, relative coordinates, or may in some embodiments be encompassed by the features in the identity which are used to verify the identity and thereby the location of the asset. The survey results, or a portion thereof, may be stored as part of the guidance plan to be compared with current inspection data obtained while operating the guidance system. The assets may be railroad components, such as ties, along a specific stretch of railroad track. Actions 305-320 may take place during and/or after an initial pass of an inspection vehicle. The guidance plan is used to designate or automatically mark assets along the predetermined path.

Actions 325-380 may be performed on a different pass than Actions 305-320 and/or may take place on a separate vehicle. In some embodiments, Actions 305-380 may take place on a single pass. In other embodiments, Actions 305-380 may be divided between multiple passes. It is foreseeable that systems with sufficient computing power may be capable of performing a survey, analyzing the condition of components, identifying assets, and generating a guidance plan while a service vehicle, such as a tie gang, follows behind to perform repairs or replacements. For example, a set of rules and/or statistical data and conditions of the assets may be used to create a guidance plan from a single pass. The statistical data may be created by applying statistical analysis to inspection data. As an inspection system traverses the railroad track, the condition of components is analyzed and assets are identified. Using a known position of a tool with respect to the inspection system, a velocity of the inspection system, a velocity of the tool, and/or real-time location coordinates from a coordinate locating system, such as measurements from an encoder, the position of a tool following behind the inspection system is identified. When the tool is aligned with one of the assets, the tool may be used to mark or service the asset. In other words, the guidance plan may be generated from the inspection data, and the identity of the assets may be defined using a known position of a tool with respect to the inspection system, a velocity of the inspection system, a velocity of the tool, and/or real-time location coordinates from a coordinate locating system. The velocity of the inspection system may be equal to the velocity of the tool if the tool forms part of the same consist as the inspection system. In some embodiments, these elements are used in addition to the previous and current features of the railroad track to align a tool with an asset after being scanned by an inspection system.

Action 325 includes determining the current location of a marking tool of a guidance system or of another tool, such as a component tool used to service a component. The guidance system may be system 100. The marking tool is configured to place indicators on or near assets along the predetermined path. Using a coordinate locating system of the guidance system, the current location of the tool is determined. The coordinate locating system may include a GPS and/or an encoder.

In Action 330 of method 300, the position of an asset is obtained from the guidance plan. A controller of the guidance system may locally or remotely access the guidance plan corresponding to the predetermined path in order to obtain the asset position. In Action 335, the position of the asset is compared to the current location of the marking tool by a processor of the controller. In Action 340, the position of the asset to be marked is correlated with the location of the guidance system. As the guidance system travels along the predetermined path in either direction, the controller updates the current location using the coordinate locating system to correlate to the position predicted within the guidance plan. The current location of the guidance system may be updated until it corresponds to the position of an asset to be marked. In some embodiments, GPS data is utilized to determine a general region of the guidance system. The location of the guidance system may be further refined through or replaced with the use of an encoder.

In some instances, the coordinate locating system alone may be insufficient to adequately correlate the current location of the guidance system with respect to the position identified in the guidance plan. Distinguishing features of the assets may be used to correlate and verify the identity of assets along the predetermined path. In some embodiments, the correlated features may be used to indirectly identify an asset to be marked. For example, a known distance of the correlated features from an asset to be marked may be used to align a marking tool or component tool with the asset to be marked. In railroad applications, current track features obtained from an inspection system may be periodically compared to the survey data at or near the predicted location. The features may be continuously compared. If the compared data does not correlate, corrections to the current location of the guidance system are made to keep the current location aligned with the position within the guidance plan.

Method 300 may include Actions 345-370. Survey data is obtained in Action 345 of method 300 for use in comparing and correlating features. A controller of the guidance system may locally or remotely access survey data corresponding to the predetermined path. In Action 350, the predetermined path is inspected again using an inspection system to identify features of the predetermined path, such as a component's characteristics, including thermal characteristics, surface profile, position coordinates, and internal characteristics, and/or an image of the predetermined path and components along the predetermined path. The inspection system may include a 2D or 3D machine vision system. The inspection system is used to generate inspection data in Action 355 that corresponds to current conditions of the predetermined path, which is then compared with the prior survey data in Action 360. In Action 365, features within the current inspection data and features within the survey data are correlated to determine the location of the guidance system with respect to the position of the assets to be marked. In other words, asset features previously identified during the survey are compared and correlated with features currently being inspected in real time in order to determine the location of the guidance system relative to an asset to be marked, serviced, or otherwise located. For railroad tracks, these features may include, but are not limited to the leading or trailing edge of ties, joint bars, crossings or bridges, patterns on the surface of a tie, such as texture or crack location, or plate size and/or plate cut measurement.

Algorithms and machine visions systems may be used to correlate the data. In other embodiments, an operator may review the current characteristics side-by-side or overlaid with the survey data to correlate the guidance system's current location with the position of the assets in the guidance plan and manually adjust the current location of the marking tool. In Action 370, the correlated data may be used to update the current location of the guidance system relative to the asset to be marked. In some embodiments, the component whose position and features are compared and correlated is different from the asset being marked. In Action 330, the identity and position of a reference component, such as another railroad component, may be obtained from the guidance plan. In Action 335, the position of the reference component is compared to the current location of the guidance system. In Action 340, the position of the reference component is correlated to determine the current location of the guidance system along the railroad track. Then, a known relative position between an asset to be marked and the reference component may be utilized to align the marking tool with the asset to be marked. In Actions 360-370, features of the reference component obtained from the current inspection data are compared and correlated with features within the survey data to determine and update the location of the marking tool or component tool along the railroad track. The known relative position between an asset to be marked and the reference component may be utilized to align the marking tool or component tool with the asset to be marked and serviced.

The initial track survey may be conducted on a separate occasion. The same inspection vehicle that conducted the survey may also be equipped with the guidance system to mark and/or service the assets on a subsequent pass. In some embodiments, the track survey of a first set of assets may be performed simultaneously with marking of a second set of assets. A known distance between the inspection system conducting the survey and the marking tool or component tool may be used to correlate the current position of the tool with the position of an asset to be marked or serviced. The guidance system may be mounted upon the inspection vehicle conducting the survey or towed in a trailer behind the inspection vehicle. The inspection system surveys the track, processes the data to determine railroad components to be replaced, repaired, or otherwise serviced and a guidance plan is generated identifying the assets to be replaced or repaired. As the inspection vehicle continues to survey another portion of the track, the guidance system marks the assets or the component tool services the assets as identified in the guidance plan. Generation of the guidance plan may be performed within the inspection vehicle during a single pass. However, with the development of communication links capable of supporting greater speeds and bandwidth, it is foreseeable that survey data may be transmitted to another location, analyzed to generate a guidance plan, and the guidance plan relayed back to the inspection vehicle or guidance system before the guidance system passes the assets identified to be marked. In yet another embodiment, the guidance system may be mounted upon a second rail-traversing vehicle following the inspection vehicle. Information obtained from the survey may be processed by the inspection vehicle or the second rail-traversing vehicle to form the guidance plan used by the guidance system on the second rail-traversing vehicle.

The method 300 may include physically marking the asset in Action 375. The controller may automatically access, or an operator may instruct, an action that corresponds to a particular asset. The action or actions corresponding to a particular asset may be stored within the guidance plan. The action may include physically marking an asset, replacing an asset, repairing an asset, or conduct further examination or monitoring of the asset. If the action indicates that the asset should be physically marked, when the marking tool is aligned with the asset, the controller initiates the marking phase. During the marking phase, the marking tool places physical indicators on or near the asset. For example, a paint stripe may be placed along the width of a degraded tie. Once the asset has been marked, the controller releases the trigger to terminate the marking phase. The process is continued until each asset identified in the guidance plan has been physically marked by the marking tool or other action has taken place according to the guidance plan. Subsequently, a replacement crew or specialized machine may use the physical marks to identify railroad components to be replaced or repaired. In Action 380, the asset may be examined or serviced. In some embodiments, the asset may be examined or serviced without any physical marking taking place.

In some embodiments, the system and methods may be used to find new and/or unaccounted for changes to the components. For example, such systems and methods could be used to determine whether maintenance was performed to the correct components or if unauthorized changes were made to other components. In one instance, a tie gang may operate upon a railroad track and replace a group. A scan of the railroad track may be conducted to generate current inspection data, and a comparison and correlation of the current inspection data to previously gathered survey data would indicate any components that have changed, such as ties that are in different positions. An alert may be triggered upon a graphical user interface to inform an operator of these changes. In other words, an alert may be created when a railroad component from the current inspection data is correlated to an asset in the previous survey data, but the current features are different from the previous features, indicating that a change to the component has occurred. The creation of the alert may be the action corresponding to the asset in the guidance plan, if the different features are detected. In this manner, the operator could quickly identify if the proper ties were replaced and the work could be checked. Likewise, changes to components caused by other events, such as a washout of ballast by flooding or wear by rail traffic, may be more readily identified.

Figure 6:
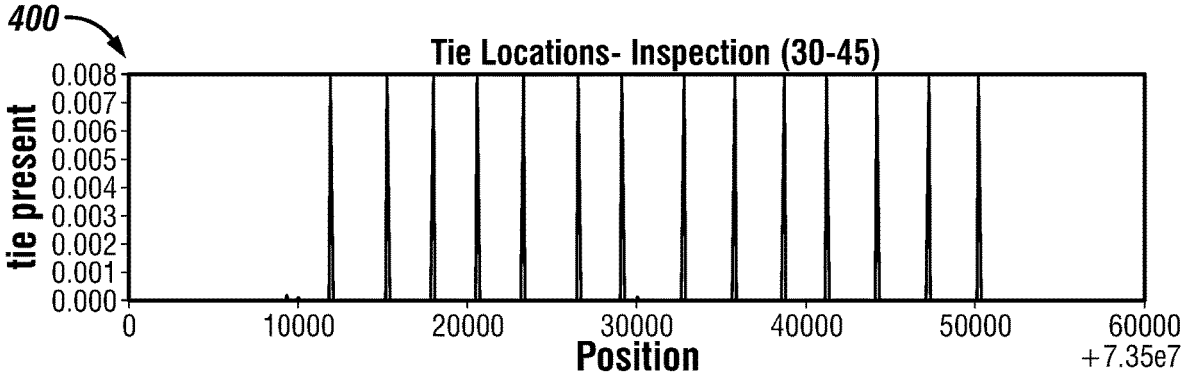
FIG. 6 shows an exemplary embodiment of an impulse signal from inspection data.
Figure 7:
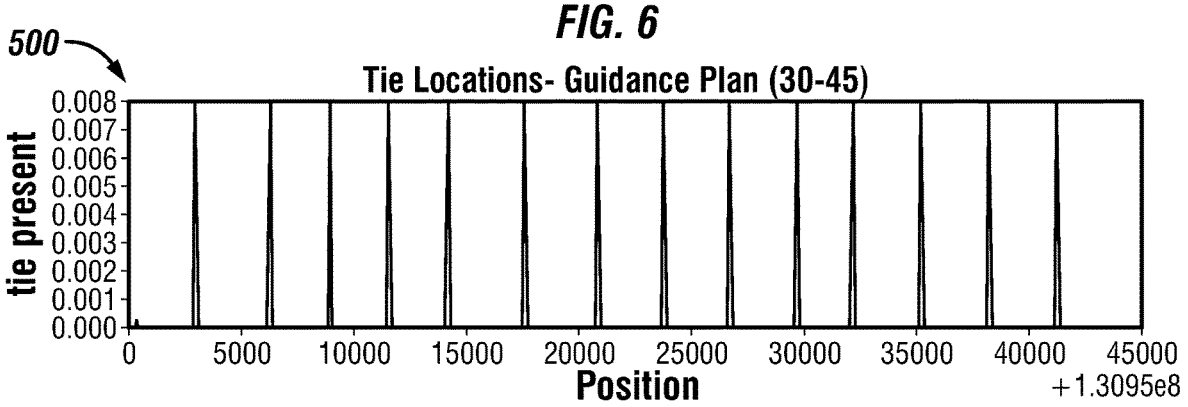
FIG. 7 shows an exemplary embodiment of an impulse signal from survey data.
Figure 8:
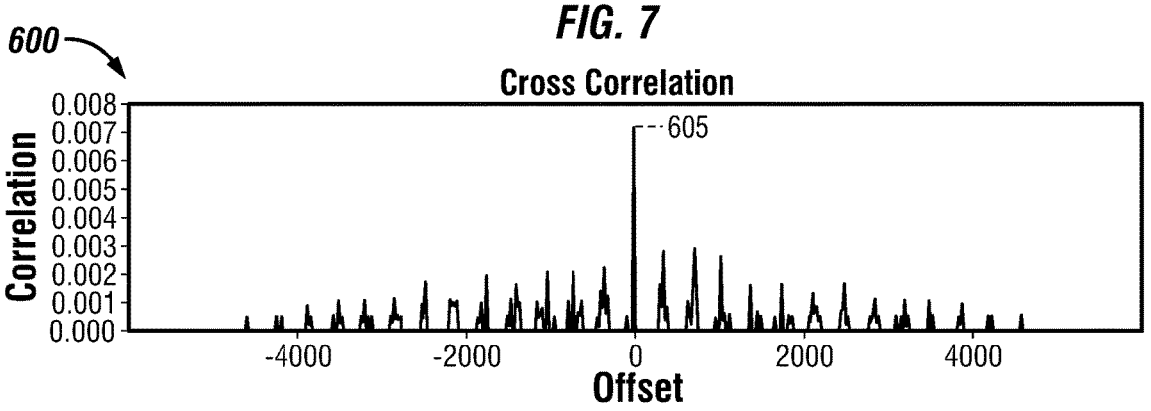
FIG. 8 shows an exemplary embodiment of a cross correlation between the embodiments of FIGS. 6 and 7.

FIG. 6-8 demonstrate an exemplary correlation of inspection data with a guidance plan that focuses on tie location. FIG. 6 shows an impulse signal 400 from a current survey that is used to create inspection data. FIG. 7 shows an impulse signal 500 from a prior survey, where the survey data was used to construct a guidance plan. In the inspection data impulse signal 400 and the guidance plan impulse signal 500, the positions of ties are represented as a one-dimensional signal with the abscissa representing the location coordinate of the ties. As shown in FIGS. 6 and 7, the location coordinates may be encoder tics. The survey data and inspection data may be separated into groups. For example, a group may be considered a tie neighborhood, which includes a plurality of adjacent ties, such as 15 adjacent ties. The correlation model initially estimates that all ties are regularly spaced, and irregularities in spacing between ties represent distinct features that can be used to align the same section of track at different time points. Filters, such as a Gaussian kernel, may be used to smooth the signal and reduce noise.

FIG. 8 shows a cross correlation data 600 of the inspection data impulse signal 400 and the guidance plan impulse signal 500. The cross-correlation data 600 provides a degree of detected correlation and a measure of confidence in that detection. Cross-correlation, such as by determining the dot product of the one-dimensional signal interpretation, is performed on the inspection data impulse signal 400 and the guidance plan impulse signal 500. The signals 400, 500 are shifted and the dot products are plotted with respect to the offset magnitude of the shift. A larger number of shifts may be calculated to increase the degree of confidence in the cross correlation data 600. The value 605 in the cross correlation data 600 with the largest dot product represents the best alignment between the inspection data impulse signal 400 and the guidance plan impulse signal 500. Where the cross correlation data 600 indicates a positive or negative shift to align the inspection data impulse signal 400 and the guidance plan impulse signal 500, the location of the guidance system may be corrected. In addition, while it is foreseeable that impulse signals alone may be used, data from a coordinate locating system, such as GPS and/or encoder data, may be useful for approximating the location and reducing the number of shift permutations to be examined. In addition, additional features may be used in conjunction with, or in place of, tie position. The greater the number of features used may increase the confidence level of the alignment. For example, correlated features may include: a height of a tie plate, an angular position of a tie plate, an position of a tie, a width of a tie in one or more planes, the absence of a tie plate or spike, an internal void of a tie, or a surface profile.

Figure 9:
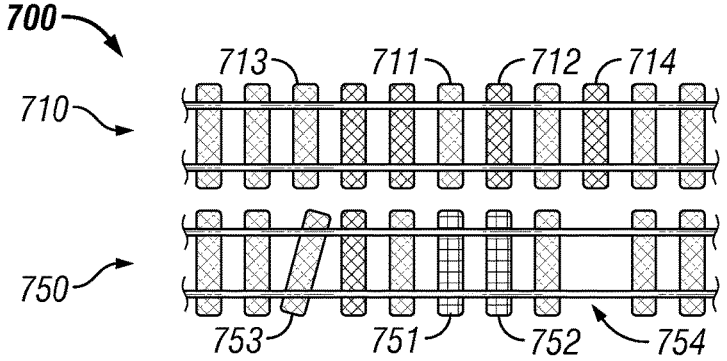
FIG. 9 is an illustration of a side-by-side comparison of survey data to inspection data of the same portion of railroad track.

FIG. 9 is an illustration of a side-by-side comparison 700 of survey data 710 to inspection data 750 of the same portion of railroad track. The survey data 710 may be an image and/or laser-line profile from a previous scan of the portion of railroad track and the inspection data 750 may be an image and/or laser-line profile from a current scan of the portion of railroad track. From the survey data 710, a guidance plan is generated that identifies ties 711 and 712 as assets to be replaced. As the inspection system scans the track and generates the inspection data 750, ties 751 and 752 are identified to be ties 711 and 712 in their present condition by correlation of the features, orientations, and/or relative spacing of the surrounding crossties and other railroad features. The system determines from the guidance plan that ties 751 and 752 should be marked, or replaced if tie replacement equipment is available, and the appropriate action is taken. In addition, due to its relative position to ties 711 and 712, tie 713 is correlated to tie 753, but it is determined that tie 753 includes different features from tie 713 because it has shifted orientation. As an operator traverses the track, an alert may be created on a graphical user interface so that the operator may determine what action should be taken as a result of the detection of the shift in orientation of tie 753. For example, the operator may manually select the action that tie 753 should be marked or replaced, or submitted for more substantially monitoring to ensure that the orientation shift does not exceed industry regulations. When the inspection system reaches the portion of the railroad track where tie 714 previous resided, it is determined that the crosstie has been removed and a space 754 is present. Another alert may be created on the graphical user interface and the operator may manually indicate that a new tie should be placed in space 754, even though it was not included in the original guidance plan.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A system for locating and servicing assets along a predetermined path, the system comprising:

survey data of features along a predetermined path, the features including a plurality of assets;

a guidance plan identifying a subset of the plurality of assets along the predetermined path, wherein the guidance plan is based only on the survey data;

an inspection system configured to travel along the predetermined path and obtain inspection data at a time later than the survey data, the inspection data corresponding to the subset of the plurality of assets along the predetermined path identified in the guidance plan; and a controller, wherein the controller is configured to analyze the inspection data by applying one or more algorithms configured to compare and correlate the assets in the inspection data with the assets in the survey data to determine a location of the inspection system.

2. The system of claim 1, wherein the inspection data comprises a first image of a portion of the predetermined path and the survey data comprises a second image of a portion of the predetermined path.

3. The system of claim 1, wherein the guidance plan includes an identity and position for each asset of the subset of the plurality of assets along the predetermined path.

4. The system of claim 3, further comprising a tool configured to travel along the predetermined path, wherein the controller is in communication with the tool, the controller including programming to operate the tool in accordance with the guidance plan, the guidance plan including an action corresponding to an asset in the guidance plan.

5. The system of claim 4, wherein the tool is a marking tool configured to place physical indicators upon or near the asset in the guidance plan, and the controller includes programming to initiate and terminate operation of the marking tool.

6. The system of claim 5, wherein the physical indicators includes one or more of a paint mark, a RFID tag, a reflective fluid, or a chemical indicator.

7. The system of claim 4, wherein the predetermined path is a railroad track and the system further comprises a rail-traversing vehicle.

8. The system of claim 7, wherein the tool is mounted on a trailer configured to be towed behind the rail-traversing vehicle.

9. The system of claim 7, further comprising a coordinate locating system configured to provide a real-time location of the tool.

10. The system of claim 9, wherein the coordinate locating system comprises an encoder.

11. The system of claim 4, wherein the inspection data and the survey data each includes features of one or more reference components, the controller includes one or more algorithms configured to compare and correlate the features of the one or more reference components in the inspection data with the features of the one or more reference components in the survey data to determine a location of the tool relative to the asset in the guidance plan, the position of the asset in the guidance plan being a known relative position from the one or more reference components.

12. A method for locating and servicing assets along a predetermined path, the method comprising:

obtaining survey data of a predetermined path by traversing the predetermined path a first time, the survey data including previous features of the predetermined path;

analyzing the survey data, the previous features of the predetermined path including assets;

generating a guidance plan based on analyzing the survey data, the guidance plan identifying specific assets along the predetermined path;

traversing the predetermined path a second time with an inspection system after generating the guidance plan, wherein generating the guidance plan is done prior to traversing the predetermined path the second time and wherein traversing the predetermined path the second time is done after completely traversing the predetermined path the first time;

using the inspection system, obtaining inspection data of the predetermined path, the inspection data including current features of the specific assets along the predetermined path; and using one or more processors, comparing and correlating the current features of the specific assets and the previous features of the specific assets to determine a position of the inspection system.

13. The method of claim 12, wherein the guidance plan includes an identity and a position of each specific asset along the predetermined path.

14. The method of claim 13, further comprising aligning a tool with one of the specific assets after determining the position of the inspection system.

15. The method of claim 14, wherein the tool is a marking tool, and the method further comprises:

signaling the marking tool with the one or more processors when the marking tool is aligned with one of the specific assets; and marking the one of the specific assets.

16. The method of claim 13, wherein generating the guidance plan further comprises:

identifying a plurality of components along the predetermined path based on the survey data;

analyzing a condition of the plurality of components;

identifying a subset of the plurality of components as a plurality of specific assets; and generating the guidance plan with the plurality of specific assets.

17. The method of claim 13, wherein the predetermined path is a railroad track and the specific assets are a plurality of railroad components.

18. The method of claim 17, wherein the plurality of railroad components includes railroad ties.

19. The method of claim 18, wherein the current features includes a relative spacing of a group of the railroad ties and the previous features includes the relative spacing of the group of railroad ties.

20. The method of claim 17, wherein the inspection data comprises a first image of a portion of the railroad track and the survey data comprises a second image of a portion of the railroad track.

21. A method for locating railroad components along a railroad track, the method comprising:

traversing a railroad track a first time obtaining survey data, the survey data including prior features of a plurality of railroad components along the railroad track;

obtaining a guidance plan, the guidance plan including an identity of each of a plurality of specific assets, the specific assets being railroad components along the railroad track that have been identified to warrant additional inspection, maintenance, or replacement based on the survey data;

traversing the railroad track a second time with an inspection system after obtaining survey data and after obtaining the guidance plan;

obtaining inspection data with the inspection system; and traversing the railroad track with a tool and aligning the tool with one of the plurality of specific assets using the identity of the one of the plurality of specific assets, wherein the tool traverses the railroad track behind the inspection system.

22. The method of claim 21, wherein the identity comprises one or more of a known position of the tool with respect to the inspection system, a velocity of the inspection system, a velocity of the tool, or a real-time location coordinate from a coordinate locating system.

23. The method of claim 21, wherein the identity includes previous features of the specific asset, and the method further comprises using one or more processors, comparing and correlating current features of the plurality of railroad components with the previous features of the plurality of specific assets to determine which of the plurality of railroad components corresponds with the plurality of specific assets.

24. The method of claim 23, wherein the comparing and correlating is performed while traversing the railroad track.

25. The method of claim 23, wherein the identity of each of the plurality of specific assets includes a position of the asset, the position of the asset being comprised of an identity of one or more reference components and a relative position of the asset with respect to the one or more reference components.

26. The method of claim 23, wherein the plurality of specific assets includes railroad ties.

27. The method of claim 26, wherein the previous features of the railroad ties includes a relative spacing of a group of the railroad ties.

28. The method of claim 26, wherein the previous features of the railroad ties includes a leading edge and a trailing edge of the railroad ties.

29. The method of claim 23, wherein at least some of the plurality of railroad components include an RFID tag with a component identifier and the previous features of the plurality of specific assets includes the component identifier.

30. The method of claim 23, further comprising creating an alert when one of the plurality of railroad components correlated to one of the plurality of specific assets contains current features that are different from the previous features.

31. The method of claim 21, further comprising repairing or replacing the one of the plurality of specific assets using the tool.

32. The method of claim 21, further comprising physically marking the one of the plurality of specific assets using the tool.

33. A method for correlating inspection data, the method comprising:

creating a guidance plan impulse signal of survey data that includes previous features of specific assets along a predetermined path;

creating an inspection data impulse signal of inspection data that includes current features of the specific assets along the predetermined path;

separating the survey data and the inspection data into one or more groups; and aligning at least a portion of the inspection data with at least a portion the survey data based on irregularities in the one or more groups.

34. The method of claim 33, further comprising generating cross correlation data from the guidance plan impulse signal and the inspection data impulse signal, wherein the cross correlation data provides a degree of detected correlation and a measure of confidence.

35. The method of claim 34, wherein generating cross correlation data further comprises determining a dot product on the guidance plan impulse signal and the inspection data impulse signal.

36. The method of claim 35, wherein determining the dot product further comprises shifting one or both the guidance plan impulse signal and inspection data impulse signal.

* * * * *